US007798338B2

(12) United States Patent
Maheu et al.

(10) Patent No.: US 7,798,338 B2
(45) Date of Patent: Sep. 21, 2010

(54) WALL MOUNTED MERCHANDISING SYSTEM

(76) Inventors: Spencer P. Maheu, 1 E. Street Ct., South Hadley, MA (US) 01075; Alex Tetiyevsky, 1 Hilltop Ct., Springfield, NJ (US) 07081

( * ) Notice: Subject to any disclaimer, the term of this patent is extended or adjusted under 35 U.S.C. 154(b) by 693 days.

(21) Appl. No.: 11/404,129

(22) Filed: Apr. 15, 2006

(65) Prior Publication Data

US 2007/0241070 A1 Oct. 18, 2007

(51) Int. Cl.
*A47F 5/08* (2006.01)
*A47G 29/02* (2006.01)

(52) U.S. Cl. ..... 211/94.02; 211/103; 248/220.41

(58) Field of Classification Search ..... 211/54.1, 211/57.1, 59.1, 87.01, 94.01, 94.02, 103; 52/590.2; 248/220.31, 220.41, 303
See application file for complete search history.

(56) References Cited

U.S. PATENT DOCUMENTS

| | | | | | |
|---|---|---|---|---|---|
| 2,100,421 | A | * | 11/1937 | Wupper | 273/265 |
| 2,996,192 | A | * | 8/1961 | Dell et al. | 211/49.1 |
| 3,172,540 | A | * | 3/1965 | Berge | 211/106.01 |
| 3,452,959 | A | * | 7/1969 | Ishikawa | 248/488 |
| 3,497,079 | A | * | 2/1970 | Kulwiec | 211/87.01 |
| 3,799,357 | A | | 3/1974 | Govang | |
| 4,480,755 | A | * | 11/1984 | Cartwright | 211/70.6 |
| 4,509,648 | A | * | 4/1985 | Govang et al. | 211/70.6 |
| 4,516,681 | A | * | 5/1985 | Jahel | 211/59.1 |
| 4,932,538 | A | * | 6/1990 | Gambello | 211/87.01 |
| 5,083,668 | A | | 1/1992 | Bushey | |
| 5,775,046 | A | * | 7/1998 | Fanger et al. | 52/590.1 |
| 5,927,517 | A | | 7/1999 | Lipman et al. | |
| 5,944,203 | A | * | 8/1999 | Vlah et al. | 211/189 |
| 6,015,124 | A | | 1/2000 | Loy | |
| 6,062,399 | A | | 5/2000 | Henry et al. | |
| 6,481,584 | B1 | * | 11/2002 | Cantley | 211/87.01 |
| 6,491,172 | B2 | | 12/2002 | Chance et al. | |
| 6,929,131 | B1 | * | 8/2005 | Landi | 211/87.01 |
| 6,945,414 | B1 | * | 9/2005 | Stevens et al. | 211/94.01 |
| 2004/0226901 | A1 | * | 11/2004 | Berg | 211/87.01 |
| 2007/0023464 | A1 | * | 2/2007 | Barkdoll et al. | 223/85 |

* cited by examiner

*Primary Examiner*—Michael Safavi
(74) *Attorney, Agent, or Firm*—McCarter & English, LLP

(57) ABSTRACT

A merchandising system adaptable for displaying merchandise on a plurality of wall configurations including, but not limited to, varying pegboard and slatted wall configurations. The system includes one or more display modules that accept hooks for mounting displayed merchandise and one or more optional interlocking non-apertured display headers for displaying information about the mounted merchandise. The display modules and/or display headers define interlocking male and female members to connect adjacent display modules and headers. To mount the system to an adjacent wall, the system employs at least one universal mounting bracket adapted to insertedly mount to both slatted and perforated walls.

25 Claims, 12 Drawing Sheets

WALL MOUNTED MERCHANDISING SYSTEM

BACKGROUND

The present invention relates to merchandising systems, and more particularly, to a wall mounted merchandising system for displaying on a wall, merchandise, such as tools and/or tool accoutrements, and is capable of being mounted, in customizable configurations, to all types of walls, including but not limited to, perforated walls and slatted walls.

Merchandising displays are widely employed for point-of-sale mounting and displaying of consumer products. Frequently, merchandising displays utilize slatted walls (slatwall) or perforated panel board (pegboard) as a wall support and hooks and hangers of various sizes and configurations to suspend or otherwise mount the displayed merchandise. Some displays further employ labels on slatwall or pegboard or on special hangers to provide information about the merchandise. Many of these displays, however, do not provide an attractive background for the displayed product and do not provide a safe and stable structure for mounting heavier products.

In today's highly competitive marketplace where rival manufactures contend for market share of similarly classified goods, it has become increasingly important to find ways to distinguish one manufacturer's products from the rest of the field. One common approach is the use of eye-catching merchandising display systems that overlay the existing wall structure at a given store. However, one of the disadvantages that manufacturers face when designing merchandising systems is that wall structures vary from store to store; for example, the width of the slats of a slatwall can vary as can the vertical and/or horizontal distances between the perforations in a pegboard style wall. These variations make it difficult and expensive for manufacturers to configure merchandising systems because it forces them to design custom systems that work with each encountered wall configuration or retrofit older, less eye-catching display systems to display their products in a satisfactory and marketing savvy manner.

In view of the above, several prior art merchandising systems have been devised to address the abovementioned issues; however, these systems employ a complex system of bracketing hardware and paneling that are expensive to manufacture and time consuming to assemble and disassemble. Furthermore, these systems are dimensionally inflexible in that they do not offer the store-owner or manufacturer the convenient flexibility to control the amount of space allotted to a particular product or group of products in both the vertical and horizontal directions, as the systems take up a set amount of space and/or are difficult to make size adjustments to.

For the foregoing reasons, there is a need for a merchandising display system that can mount to a wide range of existing in-store wall configurations including, but not limited to, slatwall and perforated wall configurations, is eye-catching and appealing to the consumer in such a way as to showcase and distinguish the displayed merchandise, is simple to assemble, disassemble and make size adjustments to, and is strong enough to safely and securely mount heavier goods. Accordingly, it is an object of the present invention to overcome one or more of the above-described drawbacks and/or disadvantages of the prior art while satisfying one or more of the aforementioned needs.

SUMMARY

The merchandising system herein described comprises an arrangement of one or more display modules. Each display module defines a front surface, a rear surface opposite the front surface, a plurality of apertures or perforations extending between the front and rear surfaces, and a peripheral edge extending rearwardly about the periphery of each display module. The peripheral edge includes a top peripheral edge plane, a bottom peripheral edge plane opposite the top plane, and two opposing side peripheral edge planes, wherein each of the planes is substantially perpendicular to the front and rear surfaces.

Furthermore, each display module includes at least one mounting bracket securing member for securing a mounting bracket described in further detail below. Each mounting bracket securing member includes a plurality of substantially parallel locking tabs defined by a portion of the front and rear surfaces of the display module. Each locking tab is moveable between a locking position and an unlocking position and is biased towards the locking position, in which case the locking tabs are substantially flush with the front surface when in the locking position. Each mounting bracket securing member further includes a plurality of substantially parallel hook-like members that outwardly project from the rear surface. Each hook-like member has a receiving slot for receiving a portion of the mounting bracket.

To provide information about a particular displayed product, the merchandising system further includes at least one optional non-apertured display header. Each display header defines a substantially flat front surface, a rear surface opposite the front surface, and a peripheral wall extending rearwardly about the periphery of each display header. The peripheral wall includes a top peripheral wall plane, a bottom peripheral wall plane opposite the top plane, and two opposing side peripheral wall planes, wherein each peripheral wall plane is substantially perpendicular to the front and rear surfaces.

To connect the display modules and display headers, each display module and header employs at least one male connecting member and at least one female connecting member. Each connecting member is defined by at least one of the peripheral edge planes and and/or at least one of the peripheral wall planes, and the at least one female connecting member is defined by at least one of the peripheral edge planes and/or at least one of the peripheral wall planes. The male and female connecting members interlock to connect at least one of (i) adjacent peripheral edge planes of adjacent display modules, (ii) adjacent peripheral wall planes of adjacent display headers and (iii) one adjacent peripheral edge plane of a display module and one adjacent peripheral wall plane of a display header.

To mount the merchandising system to a wall, for example, to a slatwall or pegboard style perforated wall, the system includes at least one universal mounting bracket that defines a substantially linear horizontal portion (or wire) and at least one prong. The horizontal portion is inserted into the receiving slots of the hook-like members of each mounting bracket securing member and locked into place against the rear surface by the locking tabs. The at least one prong extends upwardly and outwardly from the horizontal portion and defines an upper L-shaped portion and a lower L-shaped portion. The upper L-shaped portion is configured for insertion between any two slats of a slatted wall and configured for insertion into at least one aperture of a perforated wall so that the merchandising system can be mounted to both slatted and perforated walls. The lower L-shaped portion is configured to rest against the slatted or perforated wall to support the merchandising system.

Once assembled, the merchandising system is completely customizable and can take on numerous configurations depending on the user's needs. For example, the system could comprise: a single display module, a column of two or more vertically aligned display modules, a row of two or more horizontally aligned display modules, a combination of columns and rows of vertically and horizontally aligned display modules, a random configuration of two or more non-vertically and/or non-horizontally aligned display modules, diagonally positioned display modules and/or any combination of the above. Additionally, the merchandising system take on configurations that are currently known or that later become known. Furthermore, if desired, at least one or more non-apertured display headers can be integrated at any location into any one of the aforementioned merchandising system configurations. In one embodiment, the merchandising system includes at least one column of display modules that includes two or more adjacent vertically aligned modules, each module attached to the other by way of at least one male connecting member in combination with at least one female connecting member. If more than one column is desired, each adjacent column is abutted to the other and secured by way of at least one connector tab in combination with at least one recessed edge, and each column includes at least one universal mounting bracket attached thereto for mounting the respective column to the wall. Additionally, at least one display header can be integrated at any location in the column, that is, a display header can be connected at the top of the column, at the bottom of the column or in between any two display modules to provide information where desired.

These and other features, aspects, and advantages of the present invention will become better understood with regard to the following description, appended claims and accompanying drawings.

DETAILED DESCRIPTION

Figure 1:
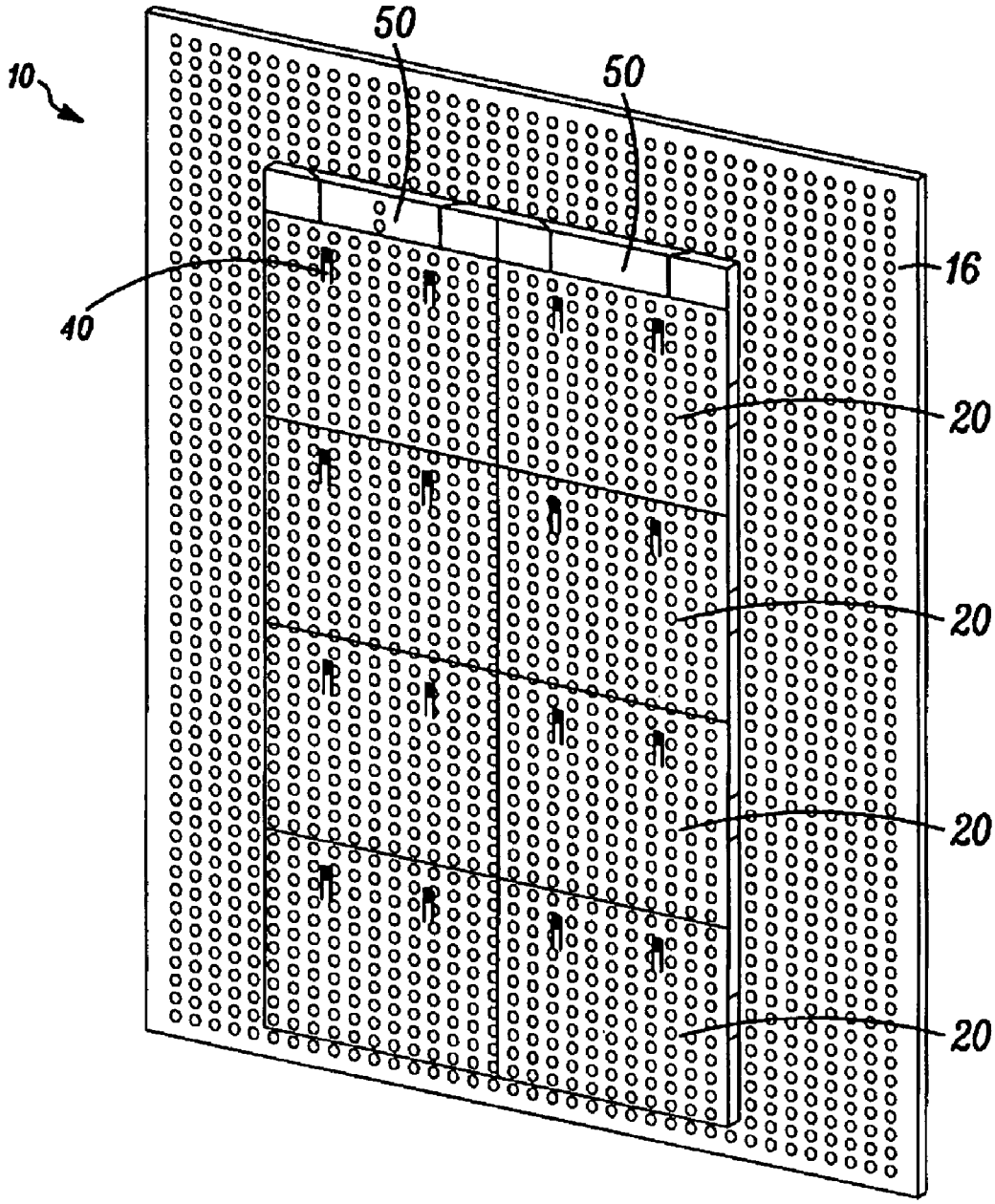
FIG. 1 is a perspective view of a merchandising system embodying the present invention.
Figure 2A:
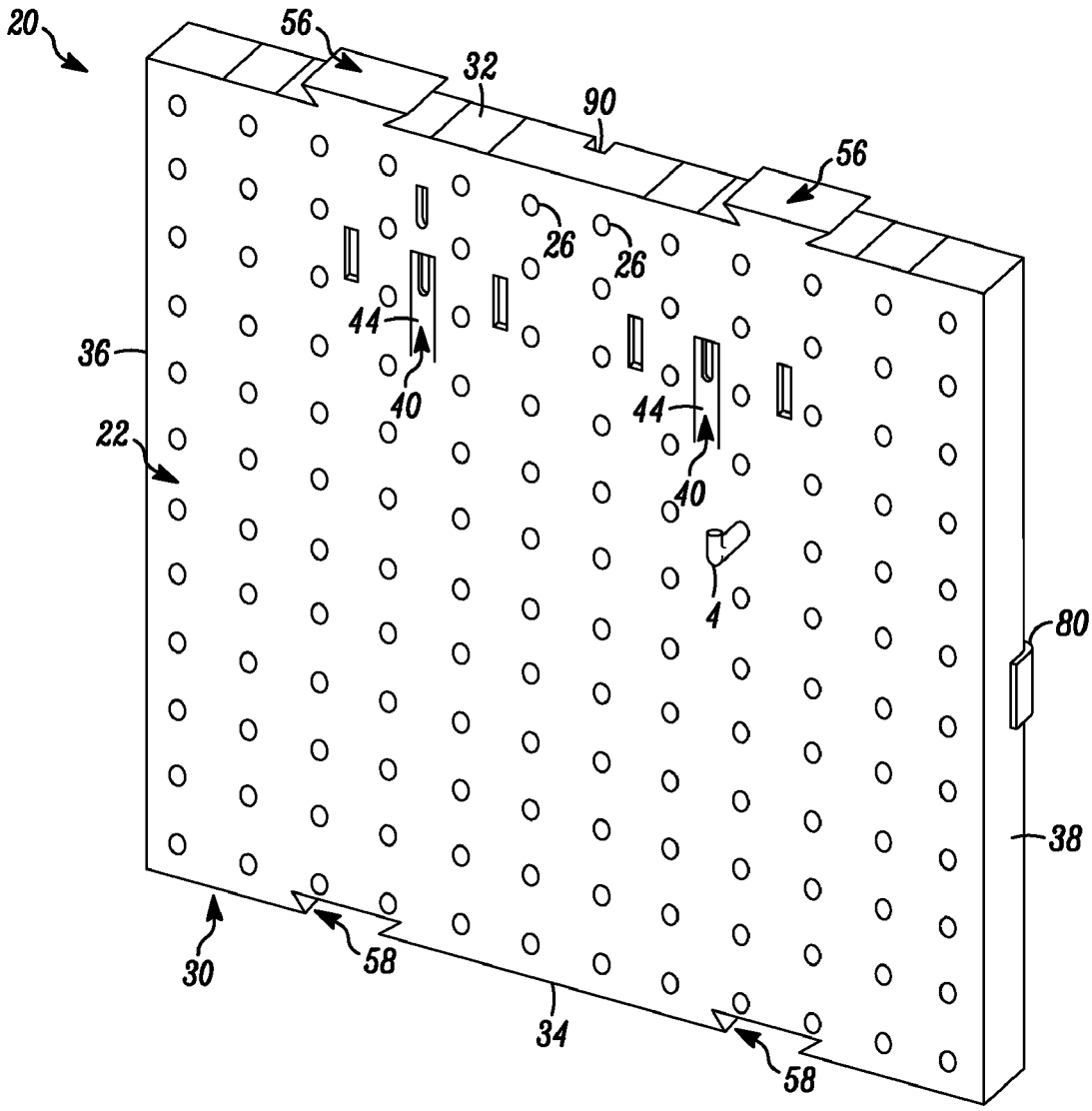
FIG. 2*a* is front perspective view of a display module of the merchandising system of FIG. 1.
Figure 2B:
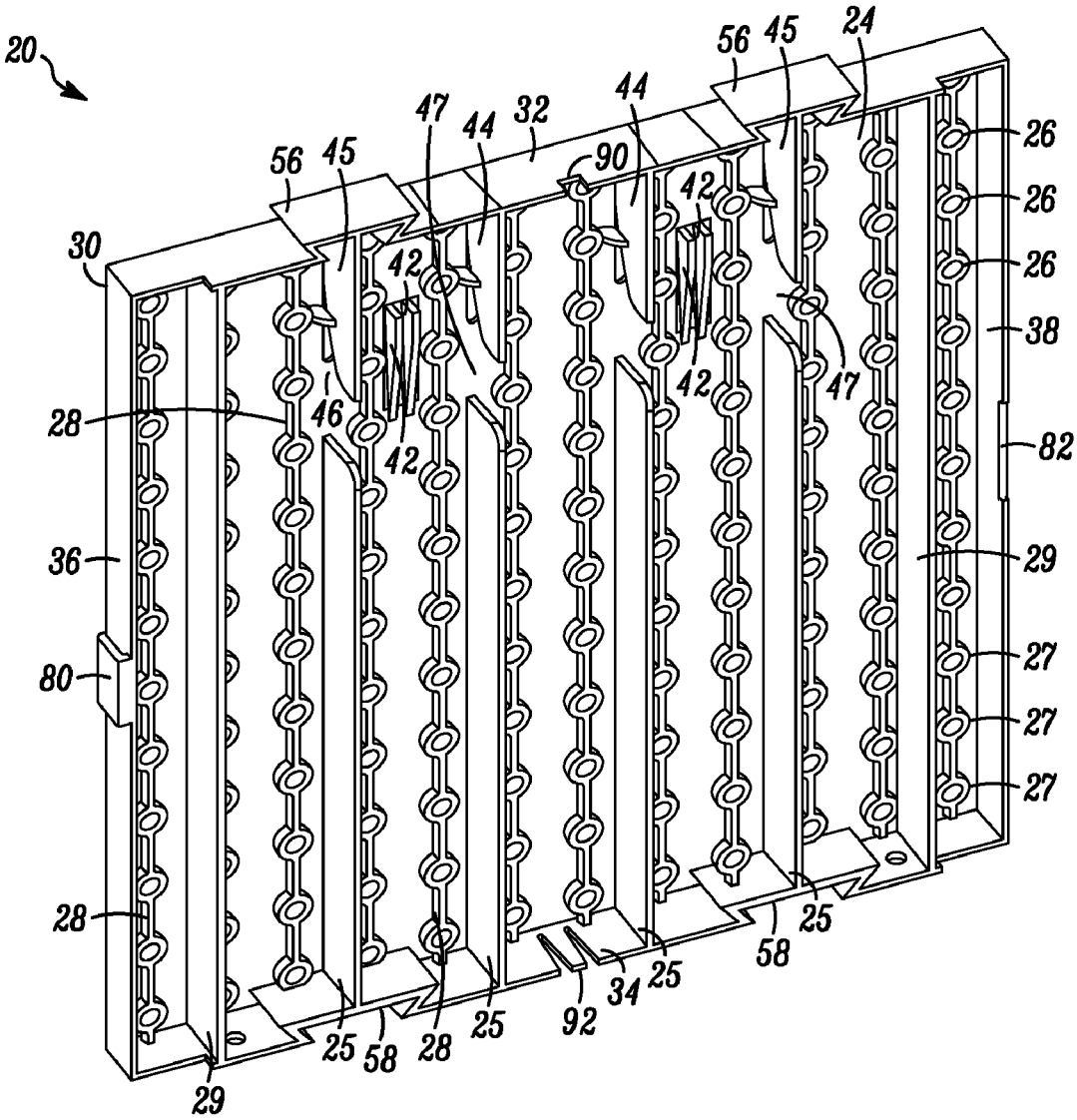
FIG. 2*b* is a rear perspective view of a display module of the merchandising system of FIG. 1.

Referring to FIG. 1, a merchandising system embodying the present invention is indicated generally by the reference numeral 10. The merchandising system 10 includes a one or more display modules 20. Drawing attention to FIGS. 2*a-b*, each display module 20 defines a front surface 22, which can be substantially flat, rounded, or take on numerous contours and configurations that are presently known or that later become known, a rear surface opposite the front surface 24, a plurality of apertures 26 or perforations extending between the front and rear surfaces, and a peripheral edge 30 extending rearwardly about the periphery of each display module 20. The peripheral edge 30 includes a top peripheral edge plane 32, a bottom peripheral edge plane 34 opposite the top plane, and two opposing side peripheral edge planes 36, 38, wherein each of plane is substantially perpendicular to the front and rear surfaces. The rear surface 24 of each display module 20 includes: a plurality of outwardly projecting support collars 27, each collar disposed about the circumference of one of the apertures 26, a plurality of support ribs 28 interspaced between adjacent support collars in the vertical and/or horizontal directions, at least one outwardly projecting inner stabilizing fin 25, and at least one outwardly projecting outer stabilizing fin 29, which add strength and rigidity to the display modules 20. To mount product to the merchandising system 10, a plurality of merchandise peg hooks 4 are employed, wherein each hook is inserted through at least one of the apertures 26 and support collars 27 and is removably securable to one of the display modules 20.

Each display module 20 further includes at least one mounting bracket securing member 40 (FIG. 9) for securing a mounting bracket described in further detail below. Each mounting bracket securing member includes a plurality of substantially parallel locking tabs 42, each defined by a portion of the front and rear surfaces 22, 24 of the display module 20. Each locking tab 42 is moveable between a locking position and an unlocking position and is biased towards the locking position, in which case the locking tabs are substantially flush with the front surface 22 of the display module 20 when in the locking position. Each mounting bracket securing member 40 further includes a plurality of substantially parallel hook-like members 44 that outwardly project from the rear surface 24 of the display module. Each hook-like member 44 has a receiving slot 46 for receiving a portion of the mounting bracket.

Figure 5A:
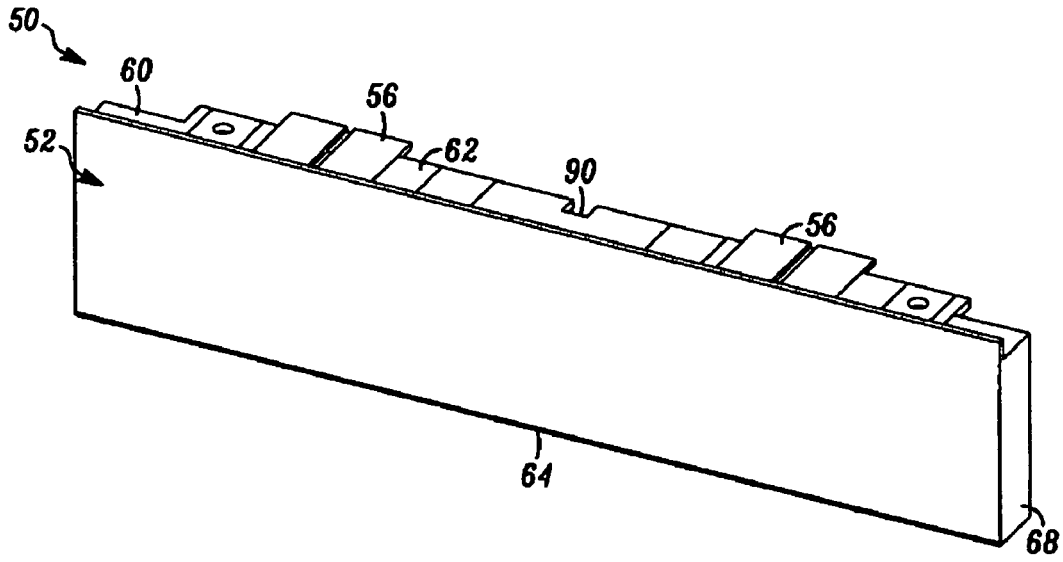
FIG. 5*a* is a front perspective view of a display header of the merchandising system of FIG. 1.
Figure 5B:
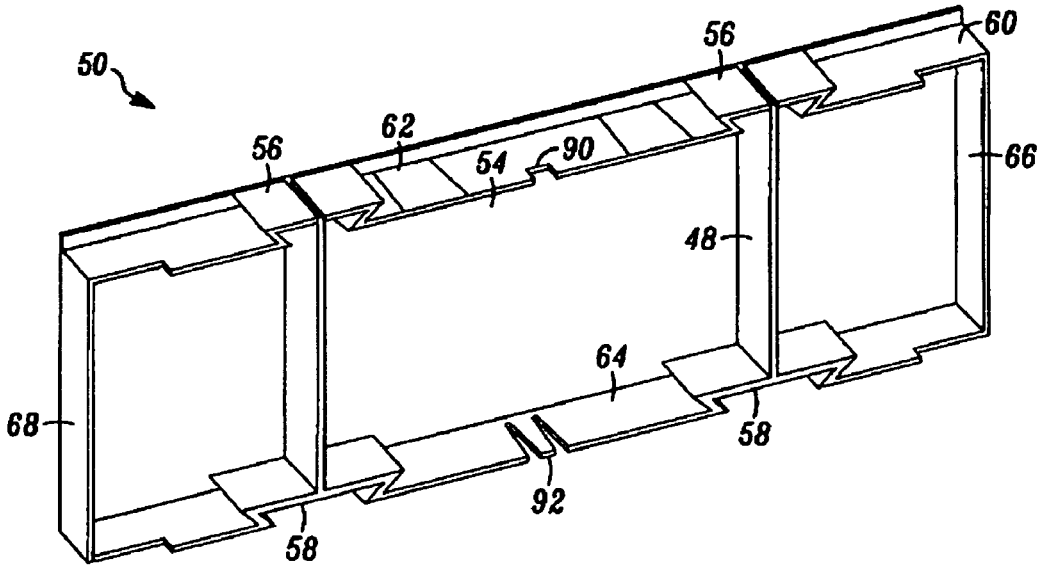
FIG. 5*b* is a rear perspective view of a display header of the merchandising system of FIG. 1.
Figure 10:
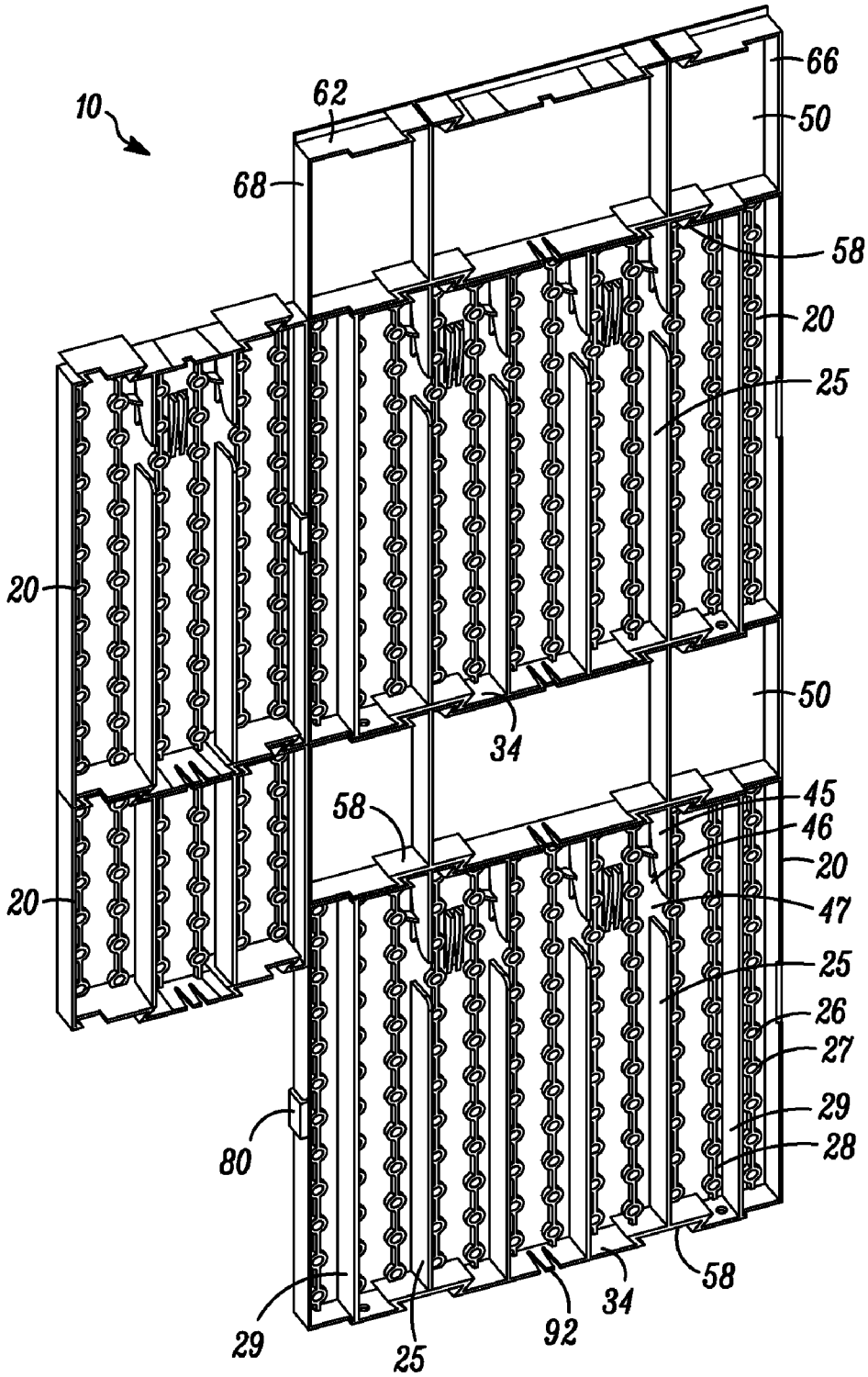
FIG. 10 is a rear perspective view of an embodiment of the merchandising system of FIG. 1.

To provide information about the displayed product, the merchandising system 10 incorporates at least one optional non-apertured display header 50 as shown in FIGS. 5*a*-5*b*. Each display header 50 defines a substantially flat front surface 52, a rear surface 54 opposite the front surface, and a peripheral wall 60 extending rearwardly about the periphery of each display header 50. The peripheral wall includes a top peripheral wall plane 62, a bottom peripheral wall plane 64 opposite the top plane, and two opposing side peripheral wall planes 66, 68, wherein each peripheral wall plane 62, 64, 66, 68 is substantially perpendicular to the front and rear surfaces 52, 54 of each display header 50. For added rigidity, at least one stabilizer support 48 extends outwardly from the rear surface 54 of the display header 50 and extends from the bottom peripheral wall plane 64 to the top peripheral wall plane 62. In one embodiment of the merchandising system 10, each display module 20 and display header 50 is shaped like at least one of (i) a rectangle and (ii) a square. It should be noted, however, that the display modules 20 and headers 50 can come in a variety of shapes, sizes and configurations that are currently known or that later become known. For example in the embodiment of FIG. 10, the modules 20 and headers 50 are shown in different sizes and varying shapes. Furthermore, although the headers and modules are typically made of plastic, they can be made of any materials or combinations of materials that are currently known or that later become known.

To connect display modules 20 and display headers 50, each display module 20 and display header 50 employs at least one male connecting member 56 and at least one female connecting member 58. Each male and female connecting member is defined by at least one of the peripheral edge planes 32, 34, 36, 38 of a display module 20 and at least one of the peripheral wall planes 62, 64, 66, 68 of a display header. The male and female connecting members 56, 58 interlock to connect adjacent peripheral edge planes 32, 24, 26, 38 of adjacent display modules 20, adjacent peripheral wall planes 62, 64, 66, 68 of adjacent display headers 50, and/or one adjacent peripheral edge plane of a display module 20 and one adjacent peripheral wall plane of a display header 50.

In one embodiment of the merchandising system 10, two male connecting member 56 are defined by the top peripheral edge plane 32 of each display module 20 and top peripheral wall plane 62 of each display header 50, and two female connecting members 58 are defined by the bottom peripheral edge plane 34 of each display module 20 and the bottom peripheral wall plane 64 of each display header 50. The display module and display header connecting members 56, 58 are similar in size and shape so that any male connecting member 56 of a display module 20 is capable of interlocking with any female connecting member 58 of a display module 20 or display header 50 and vice versa. In a further embodiment, at least one male connecting member 56 is a male dovetail and at least one female connecting member 58 is a female dovetail, the male and female dovetails forming a dovetail joint to fixedly secure adjacent display modules 20, adjacent display headers 50, and/or at least one adjacent display header 50 and at least one adjacent display module 20.

Figure 8A:
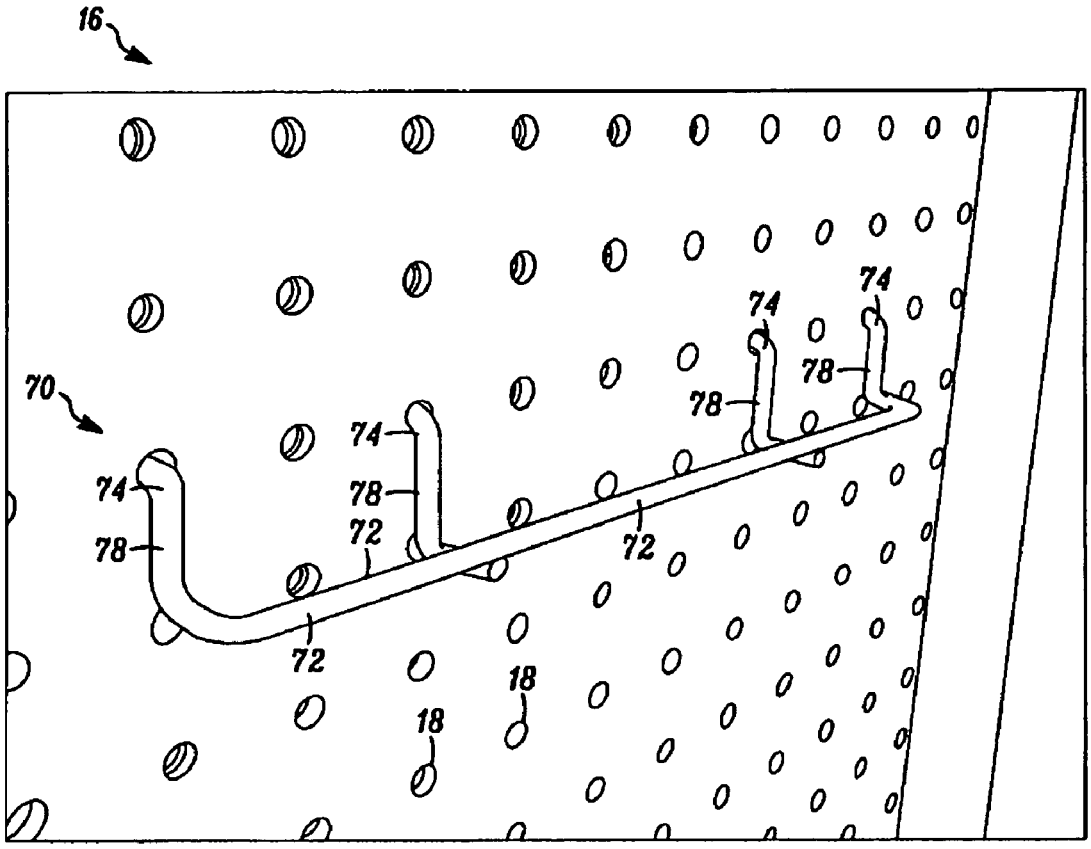
FIG. 8*a* is a perspective view of the universal mounting bracket of FIGS. 7*a-b* mounted to a pegboard style wall.
Figure 8B:
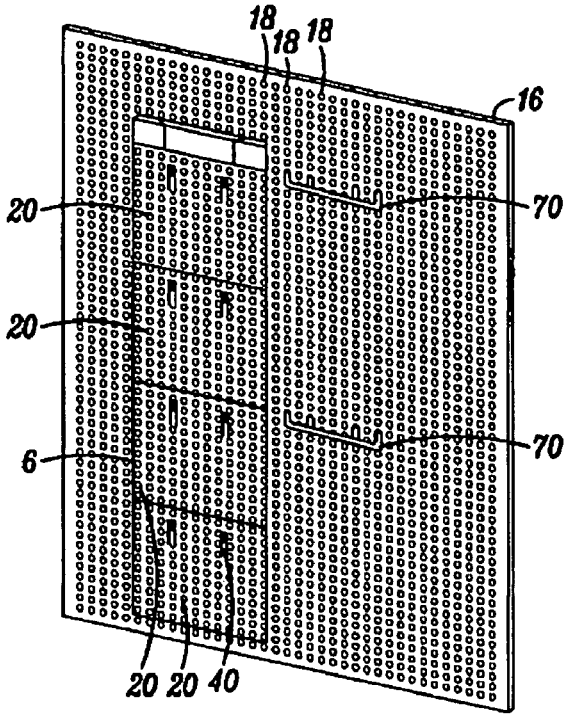
FIG. 8*b* is a perspective view of the universal mounting bracket of FIGS. 7*a-b* and a single column of display modules mounted to a pegboard style wall.

To mount the merchandising system 10 to a wall, for example, to a slatwall 12 or peg-board (perforated) style wall 16, the system 10 includes at least one universal mounting bracket 70 that comprises a substantially linear horizontal portion and a plurality (two or more) of axially spaced prongs 74, as shown in FIGS. 7*a*-7*b* and 8*a*-*c*. In one embodiment of the merchandising system 10, there are four axially spaced prongs and, in yet another embodiment of the merchandising system 10, there is one single prong. The prongs extend upwardly and outwardly from the horizontal portion and include an upper L-shaped portion 76 and a lower L-shaped portion 78. The upper L-shaped portion of each prong 74 is adapted to insertedly mount into the horizontal slots 14 between any two slats 15 of a slatwall 12 (FIG. 8*c*) and is adapted to insertedly mount into a set of apertures 18 of a perforated pegboard style wall 16 (FIGS. 8*a*-*b*). The lower L-shaped portion 76 of each prong 74 is configured to rest against the slatwall 12 or perforated wall 16 to support the merchandising system 10. To removably secure the horizontal portion 72 of a mounting bracket 70 to a display module 20, the horizontal portion 72 of the bracket 70 is inserted into the receiving slots 46 of the hook-like members 44 of the mounting bracket securing member 40. As the bracket 70 is inserted, the locking tabs 42 flex towards the unlocking position, in which case the locking tabs 42 cross the plane of the front surface 22 of the display module 20. Once the bracket 70 reaches its resting, fully seated position, the locking tabs 42 spring or snap back to the locking position to secure the bracket 70 against the rear surface 24 of the display module 20. In addition to slatwall and perforated pegboard style walls, it should be noted that the merchandising system 10 could be hung from an overhead structure, against a wall or away from a wall, without the use of the universal mounting bracket 70.

Figure 3:
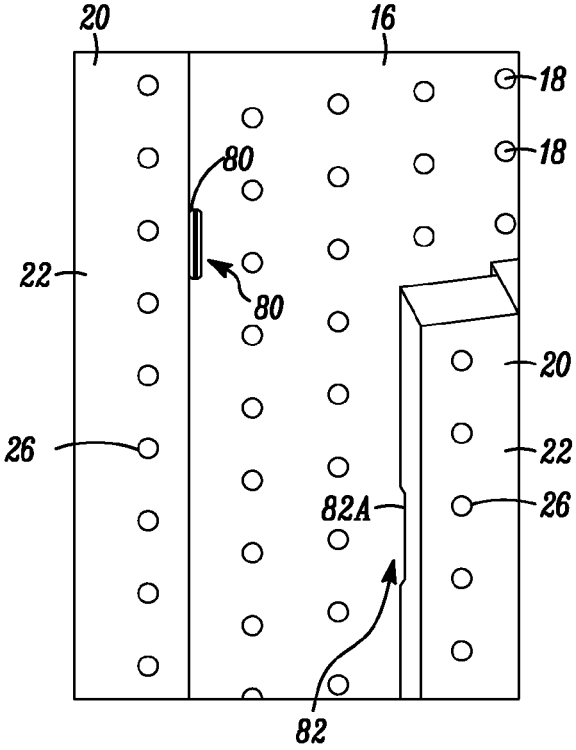
FIG. 3 is a perspective view of a connector tab and receiving slot of the display module of FIGS. 2*a-b;*
Figure 6A:
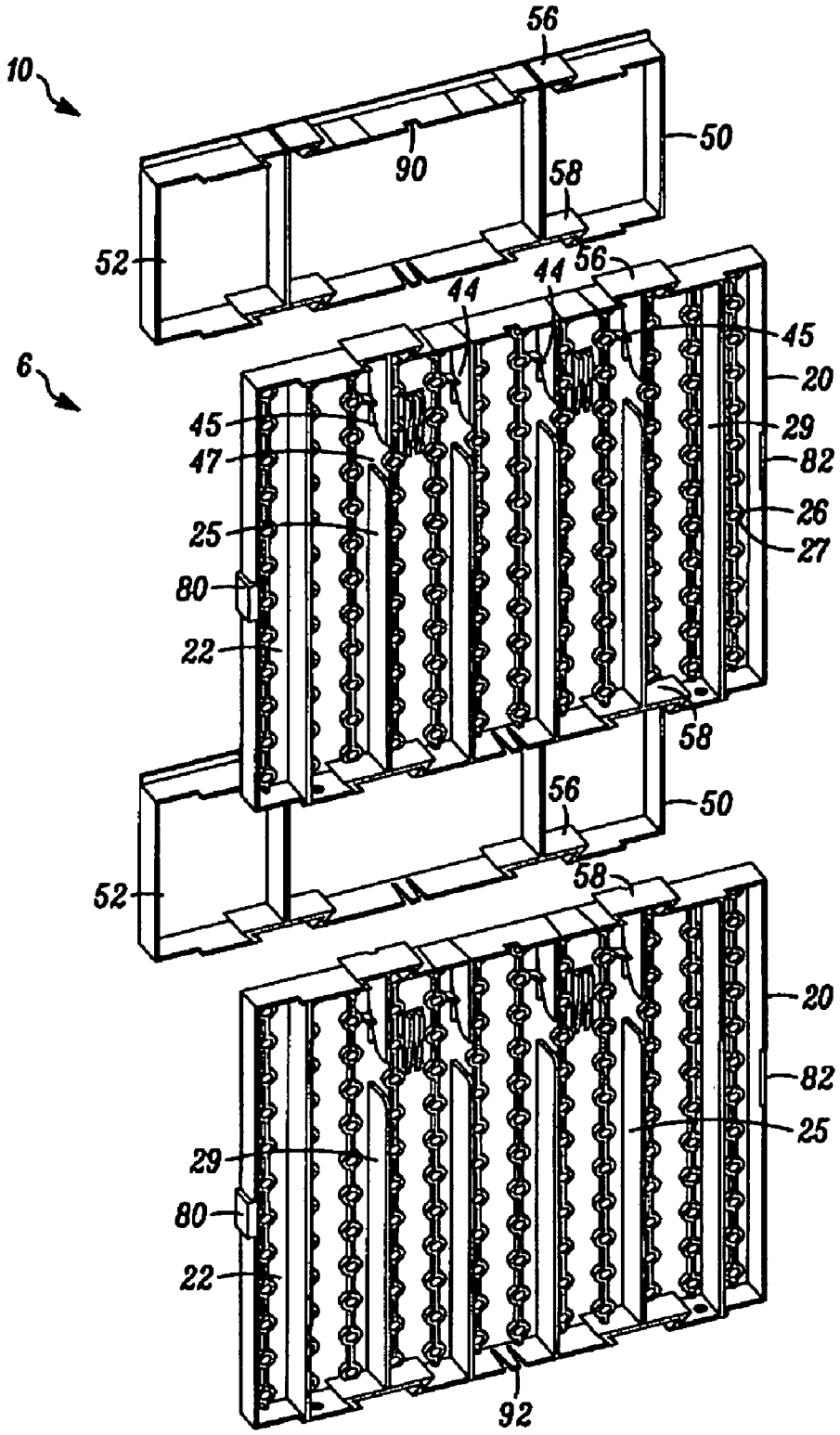
FIG. 6*a* is a rear perspective view of an unassembled column of display modules and display headers according to an embodiment of the merchandising system of FIG. 1.
Figure 6B:
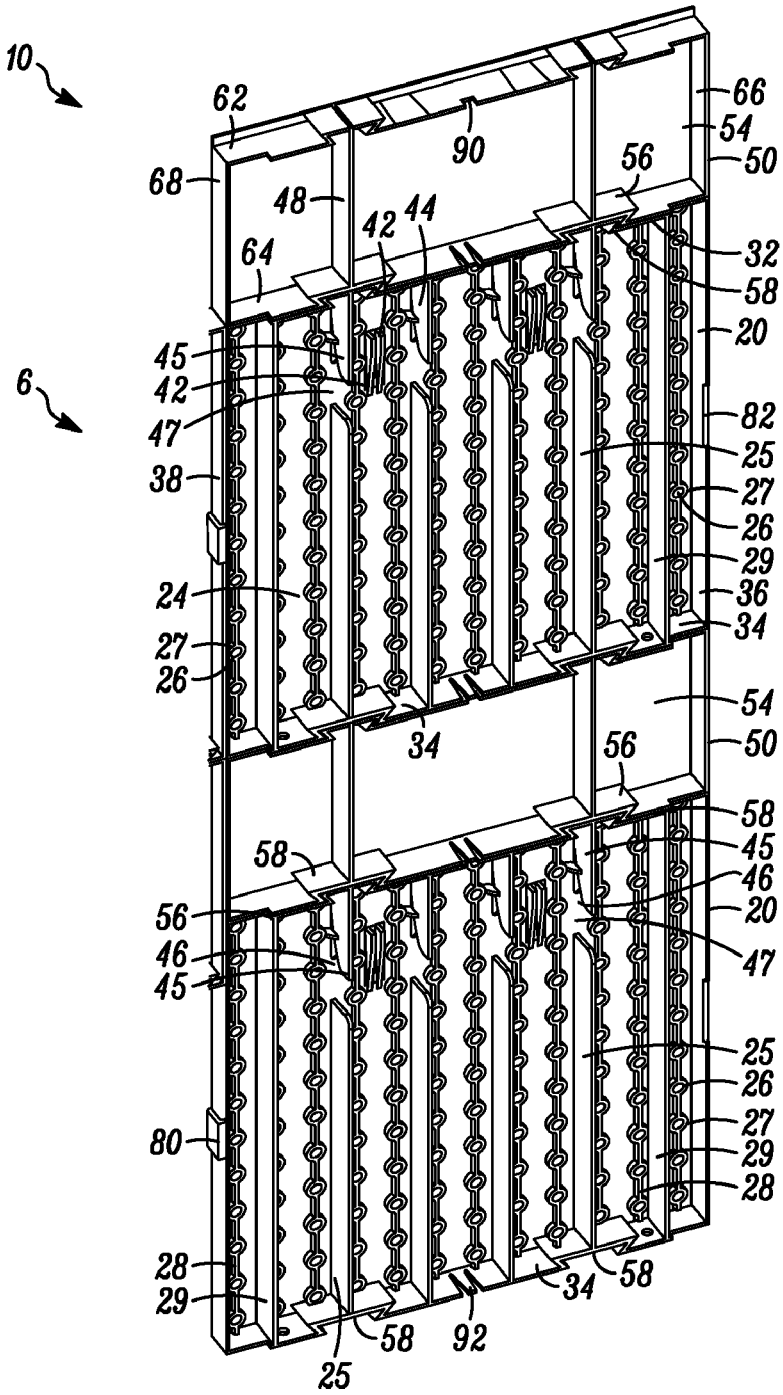
FIG. 6*b* is a rear perspective view of an assembled column of display modules and display headers according to an embodiment of the merchandising system of FIG. 1.
Figure 7A:
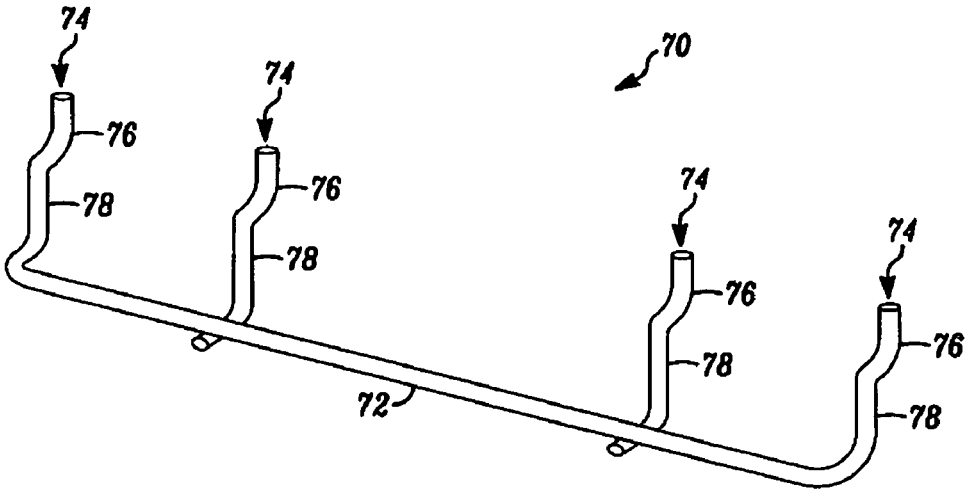
FIG. 7*a* is a front perspective view of a universal mounting bracket of the merchandising system of FIG. 1.
Figure 7B:
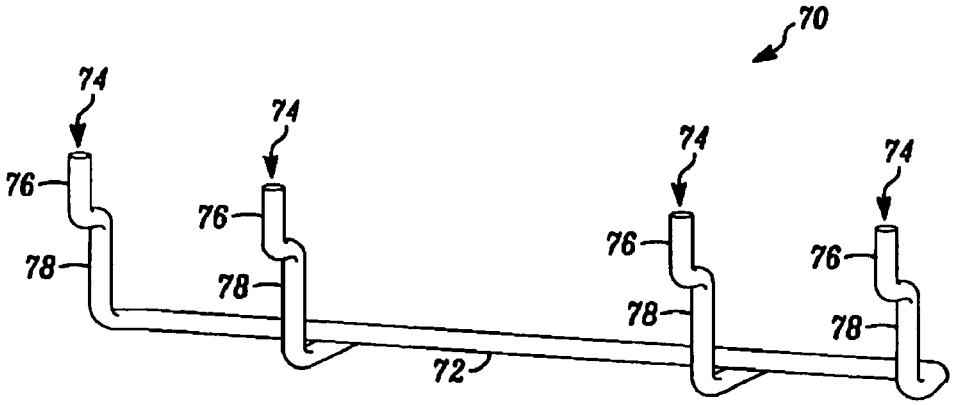
FIG. 7*b* is a rear perspective view of a universal mounting bracket of the merchandising system of FIG. 1.

Drawing attention to FIGS. 6*a*-*b*, the merchandising system, once assembled, includes at least one column 6 of display modules 20 that includes two or more adjacent vertically aligned modules, each module attached to the other by way of at least one male connecting member 56 in combination with at least one female connection member 58. It should be noted that a column can include a single display module 20 if so desired. If more than one column is desired, each adjacent column 6 is abutted to the other and secured by way of at least one connector tab 80 in combination with at least one side recess 82 that has an indented edge 82*a*, as shown in FIG. 3. Each connector tab 80 and side recess 82 is defined by a portion of one of the side peripheral edge planes 32, 34, 36, 38. Each connector tab 80 engages a corresponding side recess 82 of an adjacent display module 20, which prevents lateral movement of adjacent display modules with respect to one another once engaged. For proper mounting and support, each column of display modules 6 includes at least one of the aforementioned universal mounting brackets 70 attached to at least one display module 20 to mount the respective column to the wall. Additionally, at least one display header 50 can be integrated at any location in the column 6, that is, a display header 50 can be connected at the top of the column, at the bottom of the column or in between any two display modules 20, display headers 50, or any combination thereof to provide information where desired.

Once mounted to a wall, the position of each column 6 can be adjusted laterally (positioned) up to at least 1.5 inches or more in either the left or right direction with respect to the attached mounting bracket 70 and vice versa. This movement provides flexibility when assembling and positioning the merchandising system 10 to accommodate the dimensional variations in wall structures at different locations where the merchandising system 10 is used. To facilitate the lateral movement (positioning) and add structural integrity to the display modules 20, the inner stabilizing fins 25 extend from the bottom peripheral edge plane 24 to a point between the bottom peripheral edge plane 24 and the top peripheral edge plane 22, so that a gap 47 is provided between the stabilizer fins 25 and the hook-like members 44. The gap 47 allows for the insertion of the mounting bracket 70 and allows for the lateral movement of the column of display modules 6 with respect to the mounting bracket 70. To limit the amount of lateral movement and provide additional structural rigidity to the display modules 20, the outer stabilizing fins 29 extend completely from the bottom peripheral edge plane 34 to the top peripheral edge plane 32 of the display modules 20 and are laterally spaced away from the outermost hook-like members 45 towards the peripheral edge 30. It should be noted that the spacing between the peripheral edge 30, hook-like members 44, 45 and stabilizer fins 25, 29 can be altered to increase or decrease the amount of available lateral movement (adjustment).

Figure 4:
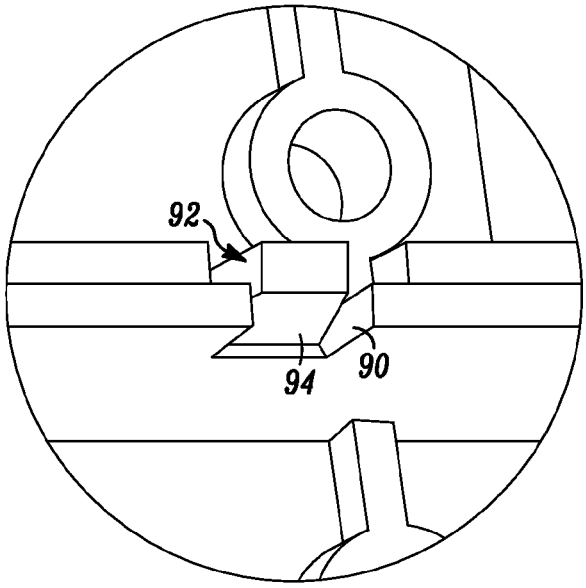
FIG. 4 is a perspective view of a lock hook assembly of the display module of FIGS. 2*a*-2*b;*

To further stabilize a column 6 of display modules 20 (with or without optional display headers 50), each display module 20 and display header 50 further include at least one recessed edge 90 and at least one lock hook 92, as shown in FIG. 4. Each lock hook 92 is movable between a first position and a second position, one of which is a locking position, and biased towards either the first or second position. In the embodiment of FIG. 4, each lock hook 92 includes a downwardly extending engagement member 94 that, when the lock hook 92 is in the locking position (as shown in FIG. 4), the engagement member 94 extends past the bottom peripheral edge plane 34 so that when the bottom peripheral edge plane 34 is positioned against the top peripheral edge plane 32 of an adjacent display module 20 or display header 50, the engagement member 94 extends into and engages the recessed edge 90 of the adjacent display module 20 or display header 50. In one embodiment, the lock hook 92 engages a corresponding recessed edge when the lock hook is in the first (locking) position and is biased towards the first position. Each recessed edge 90 and lock hook 92 is formed by a portion of at least one of the peripheral edge planes 32, 34, 36, 38 of a display module 20 and formed by a portion of at least one of the peripheral wall planes 62, 64, 66, 68 of a display header 50. In one embodiment of the merchandising system 10, each display module 20 and display header 50 includes one recessed edge 90 and one lock hook 92. In this embodiment, the recessed edge 90 is defined by the top peripheral edge plane 32 of a display module 20 and the top peripheral wall plane 62 of a display header 50, while the lock hook is defined by the bottom peripheral edge plane 34 of a display module 20 and the bottom peripheral wall plane 64 of a display header 50.

Figure 8C:
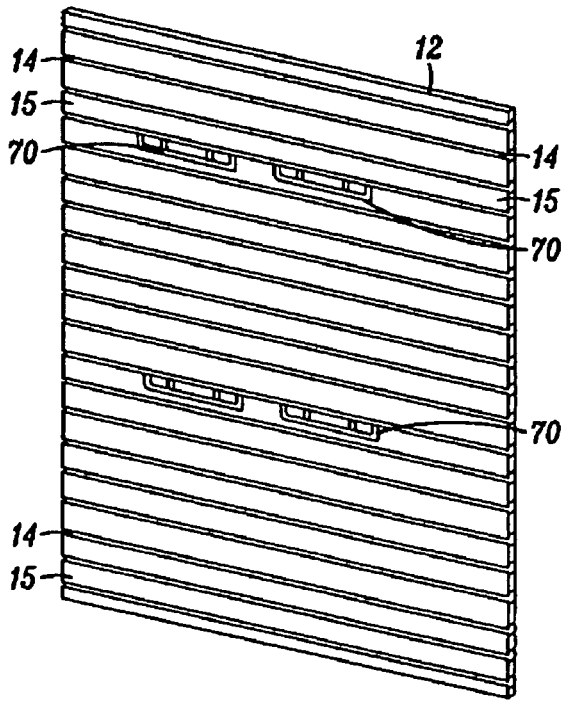
FIG. 8*c* is a perspective view of the universal mounting bracket of FIGS. 7*a-b* mounted to a slatwall.

Having thus described the merchandising system 10 above, attention will now be given to an example of at least one method of assembling the merchandising system 10. To begin assembly, the individual display modules 20 are attached in a vertical column 6 via the male and female connecting members 56, 58 and locked together via the lock hooks 92, which engage corresponding recessed edges 90, as shown in FIGS. 6*a-b*. If desired, the assembled column 6 is then placed against the wall that the system will be mounted on to determine the exact placement of the column 6 and universal mounting brackets 70, particularly if multiple columns will be used. Next, the universal mounting brackets 70 are affixed to the wall either between the slats 15 of a slatwall 12 or into the apertures 18 of a pegboard style wall 16, as shown in FIGS. 8*a-c*. To assure that the column 6 will be securely mounted to the wall, at least one mounting bracket 70 per column is employed.

Figure 9:
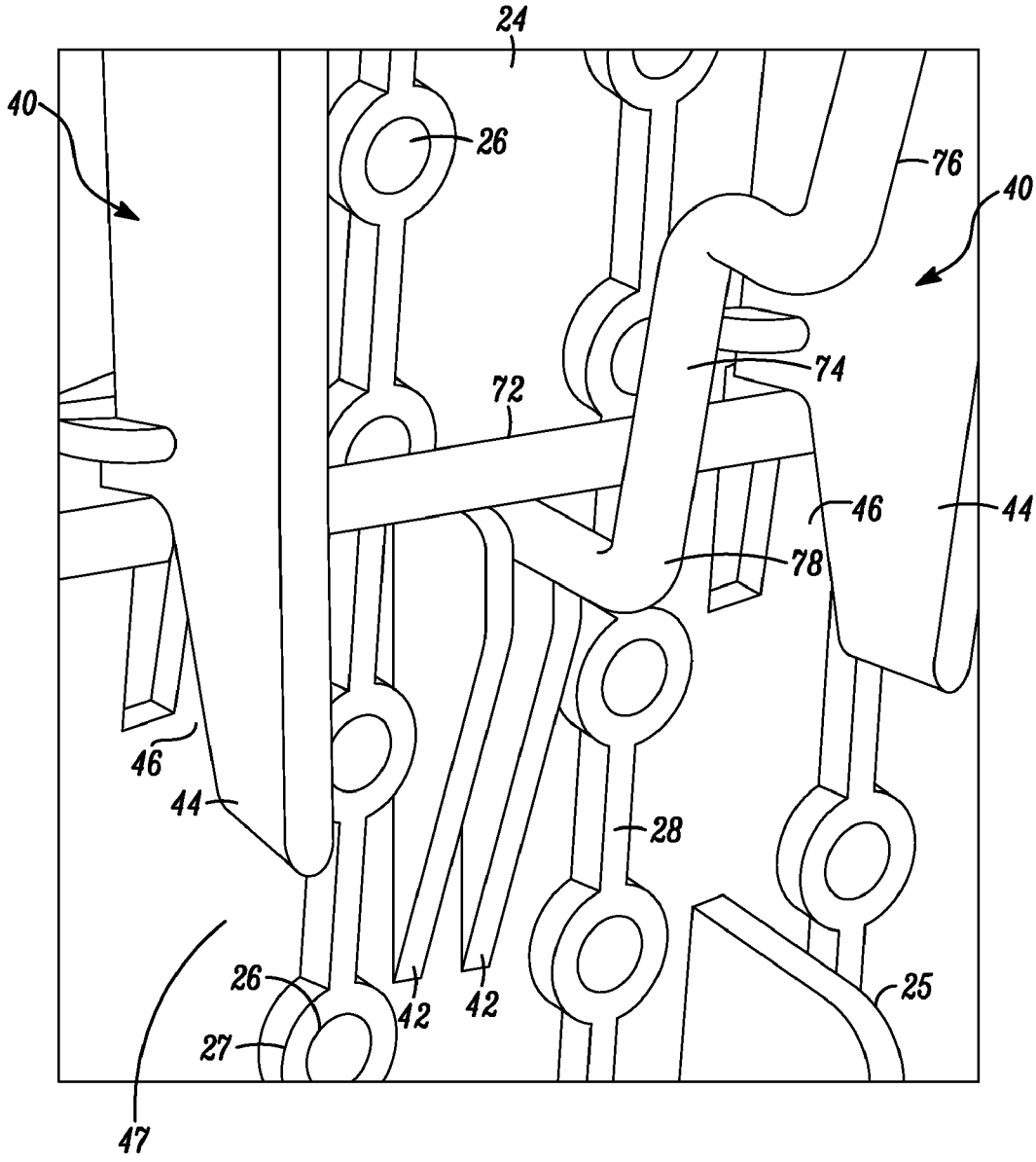
FIG. 9 is a perspective view of a section of the rear surface of the display module of FIG. 2*b* showing an embodiment of a mounting bracket securing member engaging the universal mounting bracket of FIGS. 7*a-b*.

After the mounting brackets 70 are in place, the column 6 is attached to the mounting bracket 70 such that the mounting bracket securing members 40 receive the horizontal portion 72 of the mounting brackets (FIGS. 8*b* and 9). This occurs as the column of display modules 6 is pushed against the mounting brackets 70, in which case the mounting brackets 70 slide through the receiving slot 46 of the hook-like members 44 forcing the locking tabs 42 to move through the plane of the front surface 22 of the display module 20 and then spring or snap back into place flush against the front surface 22 of the display module 20 once the mounting bracket 70 is properly seated. If multiple columns of display modules are used, the columns 6 are mounted to the wall in the same fashion as previously described. Adjacent columns are then secured together via the connection tabs 80 which engage corresponding side recesses 82 (FIG. 3). If necessary, columns 6 can be moved laterally with respect to the mounting brackets 70 to assure that abutting columns are securely attached. Finally, the optional display headers 50 are affixed to the top of each column 6 via male and female connecting members 56, 58 and locked into place via lock hooks 92, which engage corresponding recessed edges 90. If desired, display headers can be integrated into the column (i.e., between display modules) during the column assembly stage. Once assembled (FIG. 1), peg hooks 4 are inserted into the apertures 26 of the merchandising system 10 onto which the desired products (not shown) are securely hung and supported for display.

As previously noted, the merchandising system is completely customizable and flexible in that it can take on numerous configurations depending on the user's needs. For example, the system could comprise: a single display module, a column of two or more vertically aligned display modules, a row of two or more horizontally aligned display modules, a combination of columns and rows of vertically and horizontally aligned display modules, a random configuration of two or more non-vertically and/or non-horizontally aligned display modules, diagonally positioned display modules and/or any combination of the above.

While the merchandising system 10 has been described in detail above, it will be understood by those skilled in the art that various changes may be made and equivalents may be substituted for elements thereof of the apparatus and method of assembling the apparatus without departing from the spirit and scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims.

What is claimed is:

1. A merchandising system comprising:

at least one display module defining:

a front surface, a rear surface opposite the front surface, a plurality of apertures extending between the front and rear surfaces, at least one mounting bracket securing member, the at least one mounting bracket securing member including (i) a plurality of substantially parallel rearwardly extending locking tabs connected to the front surface and moveable between a locking position and an unlocking position and biased towards the locking position, and (ii) a plurality of substantially parallel hook-like members rearwardly projecting from the rear surface so that each hook-like member forms a receiving slot between the hook-like member and the rear surface, a peripheral edge extending rearwardly about the periphery of the at least one display module, the peripheral edge including a top peripheral edge plane, a bottom peripheral edge plane opposite the top plane, and two opposing side peripheral edge planes, wherein each of the planes is substantially perpendicular to the front and rear surfaces;

at least one male connecting member defined by at least one of the peripheral edge planes, and at least one female connecting member defined by at least one of the other peripheral edge planes; and at least one universal mounting bracket defining a substantially linear horizontal portion that is removably inserted into the receiving slots of the hook-like members and locked into place against the rear surface by the locking tabs, and a plurality of axially spaced prongs extending upwardly and outwardly from the horizontal portion, each prong defining an upper L-shaped portion configured for insertion between any two slats of a slatted wall and configured for insertion into at least one aperture of a perforated wall so that the merchandising system can be mounted to both slatted and perforated walls, and a lower L-shaped portion configured to rest against the slatted or perforated wall to support the merchandising system wherein (i) in the locking position, the locking tabs sufficiently extend rearwardly from the front surface and also sufficiently rearwardly past the rear surface to prevent the at least one universal mounting bracket from escaping the receiving slots of the hook-like members, and (ii) in the unlocking position, the locking tabs move forwardly such that the rearward extension of the locking tabs past the rear surface is sufficiently reduced to allow the at least one mounting bracket to escape the receiving slots of the hook-like members.

2. A merchandising system as defined in claim 1, further comprising:

at least one non-apertured display header defining:

a substantially flat front surface, a rear surface opposite the front surface, and a peripheral wall extending rearwardly about the periphery of each display header, the peripheral wall including a top peripheral wall plane, a bottom peripheral wall plane opposite the top plane, and two opposing side peripheral wall planes, each peripheral wall plane substantially perpendicular to the front and rear surfaces, wherein at least one of the peripheral wall planes defines at least one male connecting member and at least one of the other peripheral wall planes defines at least one female connecting member, wherein the at least one female connecting member is adapted to receive the at least one male connecting member of an adjacent display header or an adjacent display module.

3. A merchandising system as defined in claim 1, further comprising at least one connector tab defined by a portion of one of the side peripheral edge planes, and at least one side recess defined by a portion of one of the other side peripheral edge planes, the side recess having an indented edge, wherein the at least one connector tab is adapted to engage the indented edge of the at least one side recess of an adjacent display module.

4. A merchandising system as defined in claim 1, wherein the system comprises at least one column of two or more vertically aligned display modules, each module attached to the other by way of at least one of the at least one male connecting member interlocking with at least one of the at least one female connecting member of an adjacent display module, and each column including at least one of the at least one universal mounting bracket.

5. A merchandising system as defined in claim 4, further comprising at least one non-apertured display header.

6. A merchandising system as defined in claim 3, wherein the system comprises at least one row of two or more horizontally aligned display modules, each module attached to the other by way of at least one of the at least one connector tab engaging the indented edge of at least one of the at least one side recess of an adjacent display module.

7. A merchandising system as defined in claim 6, further comprising at least one non-apertured display header.

8. A merchandising system as defined in claim 2, wherein the at least one male connecting member is defined by the top peripheral edge plane of each display module and the top peripheral wall plane of each display header, and the at least one female connecting member is defined by the bottom peripheral edge plane of each display module and the bottom peripheral wall plane of each display header.

9. A merchandising system as defined in claim 2, further comprising (a) at least one recessed edge formed by a portion of at least one of (i) the peripheral edge planes and (ii) the peripheral wall planes, and (b) at least one lock hook formed by a portion of at least one of (i) the peripheral edge planes and (ii) the peripheral wall planes, wherein the at least one lock hook is movable between a first position for engaging the recessed edge of an adjacent display header, and a second position for disengaging the recessed edge of an adjacent display header, and the at least one lock hook is biased towards the first position.

10. A merchandising system as defined in claim 1, wherein the rear surface of each display module further includes:

a plurality of outwardly projecting support collars, each collar disposed about the circumference of one of the apertures;

a plurality of support ribs interspaced between adjacent support collars;

at least one outwardly projecting inner stabilizing fin; and at least one outwardly projecting outer stabilizing fin.

11. A merchandising system as defined in claim 10, wherein the at least one outwardly projecting inner stabilizing fin extends from the bottom peripheral edge plane to a point between the bottom peripheral edge plane and the top peripheral edge plane defining a gap or space between the at least one inner stabilizing fin and the at least one hook-like member to allow for (i) the insertion of the at least one mounting bracket and (ii) an amount of lateral adjustment between the at least one display module and the at least one mounting bracket relative to each other, and the at least one outer stabilizing fin extends completely from the bottom peripheral edge plane to the top peripheral edge plane and is laterally spaced away from the at least one hook-like member towards the peripheral edge to limit the amount of lateral adjustment.

12. A merchandising system as defined in claim 2, wherein the at least one male connecting member is a male dovetail and the female connecting member is a female dovetail, the male and female dovetails forming a dovetail joint to fixedly secure at least one of (i) at least one adjacent display module, (ii) at least one adjacent display header, and (iii) at least one adjacent display module and at least one adjacent display header.

13. A merchandising system as defined in claim 1, further comprising at least one merchandise peg hook, each hook inserted through at least one of the apertures and is removably securable to the at least one display module.

14. A merchandising system as defined in claim 2, wherein the at least one display module and the at least one display header are shaped like at least one of (i) a rectangle and (ii) a square, and the at least one universal mounting bracket has four axially spaced prongs.

15. A merchandising system comprising:

at least one display module defining:

a front surface, a rear surface opposite the front surface, a plurality of apertures extending between the front and rear surfaces, a peripheral edge extending rearwardly about the periphery of the at least one display module; and at least one mounting bracket securing member connected to the front surface and movable between first and second positions;

at least one non-apertured display header defining:

a substantially flat front surface, a rear surface opposite the front surface, and a peripheral wall extending rearwardly about the periphery of each display header;

at least one male connecting member defined by at least one of (i) a portion of the peripheral edge and (ii) a portion of the peripheral wall, and at least one female connecting member defined by at least one of (i) a portion of the other peripheral edge and (ii) a portion of the other peripheral wall, wherein the at least one male and female connecting members interlock with corresponding male and female connecting members of at least one of (i) at least one adjacent display module, (ii) at least one adjacent display header and (iii) at least one adjacent display header and at least one adjacent display module; and at least one universal mounting bracket removably secured to the at least one display module via the at least one mounting bracket securing member, and configured for insertion between any two slats of a slatted wall or into at least one aperture of a perforated wall to support and mount the system to a slatted or perforated wall;

wherein, in the first position, the at least one mounting bracket securing member secures the bracket to the at least one display module, and in the second position, the at least one mounting bracket securing member releases the bracket from the at least one display module.

16. A merchandising system as defined in claim 15, further comprising at least one connector tab defined by a portion of one side peripheral edge plane of the peripheral edge, and at least one side recess defined by a portion of one of the other side peripheral edge planes of the peripheral edge, the side recess having an indented edge, wherein the at least one connector tab is adapted to engage the indented edge of the at least one side recess of an adjacent display module.

17. A merchandising system as defined in claim 15, wherein the system comprises at least one column of two or more vertically aligned display modules, each module attached to the other by way of at least one of the at least one male connecting member interlocking with at least one of the at least one female connecting member of an adjacent display module, and each column including at least one of the at least one universal mounting bracket.

18. A merchandising system as defined in claim 16, wherein the system comprises at least one row of two or more horizontally aligned display modules, each module attached to the other by way of at least one of the at least one connector tab engaging the indented edge of at least one of the at least one side recess of an adjacent display module.

19. A merchandising system as defined in claim 15, further comprising (a) at least one recessed edge formed by a portion of at least one of (i) the peripheral edge and (ii) the peripheral wall, and (b) at least one lock hook formed by a portion of at least one of (i) the peripheral edge and (ii) the peripheral wall, wherein the at least one lock hook is movable between a first position for engaging the recessed edge of an adjacent display header, and a second position for disengaging the recessed edge of an adjacent display header, and the at least one lock hook is biased towards the first position.

20. A merchandising system as defined in claim 15, wherein the rear surface of the at least one display module further includes:

a plurality of outwardly projecting support collars, each collar disposed about the circumference of one of the apertures;

a plurality of support ribs interspaced between adjacent support collars; and a plurality of outwardly projecting stabilizing fins.

21. A merchandising system as defined in claim 15, wherein the at least one male connecting member is a male dovetail and the female connecting member is a female dovetail, the male and female dovetails forming a dovetail joint to fixedly secure at least one of (i) adjacent display modules, (ii) adjacent display headers, and (iii) one adjacent display header and one adjacent display module.

22. A merchandising system as defined in claim 15, further comprising at least one merchandise peg hook, each hook inserted through at least one of the apertures and is removably securable to the at least one display module.

23. A merchandising system as defined in claim 15, wherein the at least one universal mounting bracket defines a substantially linear horizontal portion that is captured by the at least one mounting bracket securing member, and at least one prong that extends upwardly and outwardly from the horizontal portion, the at least one prong defining an upper L-shaped portion configured for insertion between any two slats of a slatted wall, into at least one aperture of a perforated wall, or any combination thereof, so that the merchandising system can be mounted to at least slatted and perforated walls, and a lower L-shaped portion configured to rest against the slatted or perforated wall to support the merchandising system.

24. A merchandising system as defined in claim 23, wherein the at least one display module and the at least one display header are shaped like at least one of (i) a rectangle and (ii) a square, and the at least one universal mounting bracket has four axially spaced prongs.

25. A merchandising system as defined in claim 15, wherein the at least one mounting bracket securing member is biased towards the first position.

* * * * *